US007003821B2

(12) United States Patent
DeHart et al.

(10) Patent No.: US 7,003,821 B2
(45) Date of Patent: Feb. 28, 2006

(54) CHILD CONTAINMENT STRUCTURE WITH VENTILATION PANEL

(75) Inventors: Jon J. DeHart, West Lawn, PA (US); Jonathan M. Pacella, Coatesville, PA (US); Joshua E. Clapper, King of Prussia, PA (US); Cindy Berkey, Honey Brook, PA (US)

(73) Assignee: Graco Children's Products Inc.

( * ) Notice: Subject to any disclaimer, the term of this patent is extended or adjusted under 35 U.S.C. 154(b) by 0 days.

(21) Appl. No.: 10/808,597

(22) Filed: Mar. 25, 2004

(65) Prior Publication Data

US 2004/0261174 A1 Dec. 30, 2004

Related U.S. Application Data

(63) Continuation-in-part of application No. 29/185,439, filed on Jun. 30, 2003, now Pat. No. Des. 500,213.

(51) Int. Cl.
*A47D 7/00* (2006.01)
*A47D 13/06* (2006.01)
*A47C 21/04* (2006.01)

(52) U.S. Cl. ..... 5/93.1; 5/98.1

(58) Field of Classification Search ..... 5/93.1, 5/98.1, 99.1, 424, 425, 427, 946, 663, 655
See application file for complete search history.

(56) References Cited

U.S. PATENT DOCUMENTS 2,287,907 A * 6/1942 Schettler, Jr. ..... 5/98.1
3,438,069 A 4/1969 Long
3,894,304 A * 7/1975 Burbidge et al. ..... 5/93.1
4,811,437 A * 3/1989 Dillner et al. ..... 5/99.1
D365,957 S 1/1996 Ferrari
5,553,336 A 9/1996 Mariol
5,697,111 A * 12/1997 Dillner et al. ..... 5/99.1
5,778,465 A * 7/1998 Myers ..... 5/99.1
5,845,349 A * 12/1998 Tharalson et al. ..... 5/99.1
5,862,548 A * 1/1999 Gerhart ..... 5/93.1
5,933,885 A * 8/1999 Glassford ..... 5/424
6,131,216 A * 10/2000 Pine ..... 5/93.1
6,131,218 A * 10/2000 Wang ..... 5/93.1
6,170,101 B1 * 1/2001 McCloud ..... 5/424
6,178,573 B1 1/2001 Wagner et al.
6,178,578 B1 1/2001 Soltani et al.
6,192,535 B1 * 2/2001 Warner et al. ..... 5/93.1
6,418,575 B1 * 7/2002 Cheng ..... 5/93.1
6,430,762 B1 8/2002 Cheng
6,434,767 B1 8/2002 Welsh, Jr.
6,510,570 B1 * 1/2003 Hartenstine et al. ..... 5/99.1
6,578,211 B1 * 6/2003 Tharalson et al. ..... 5/93.2
D500,213 S * 12/2004 DeHart et al. ..... D6/390
6,865,756 B1 * 3/2005 Clapper et al. ..... 5/99.1
6,907,626 B1 * 6/2005 Welsh et al. ..... 5/99.1
6,931,677 B1 * 8/2005 Tharalson et al. ..... 5/95

(Continued)

*Primary Examiner*—Robert G. Santos
(74) *Attorney, Agent, or Firm*—Foley & Lardner LLP

(57) ABSTRACT

A child containment structure includes a floor and a sidewall connected to the floor and defining a unitary structure with the floor. The sidewall includes at least one side panel formed at least partially of an air-restricting material and at least one ventilation panel positioned between the floor and the side panel. The ventilation panel has a maximum height smaller than that of the side panel, and the ventilation panel permits air flow between an interior of the containment structure and an exterior of the containment structure along a sleeping surface of the child containment structure.

16 Claims, 7 Drawing Sheets

U.S. PATENT DOCUMENTS

2001/0000362 A1 * 4/2001 Wagner et al. ..... 5/424
2003/0196263 A1 * 10/2003 Hardy ..... 5/93.1
2003/0196264 A1 * 10/2003 Tharalson et al. ..... 5/95
2004/0237191 A1 * 12/2004 Clapper et al. ..... 5/99.1
2004/0261174 A1 * 12/2004 DeHart et al. ..... 5/93.1
2005/0150046 A1 * 7/2005 Gehr et al. ..... 5/99.1
2005/0166316 A1 * 8/2005 Gehr et al. ..... 5/99.1
2005/0172400 A1 * 8/2005 Hardy ..... 5/93.1
2005/0198733 A1 * 9/2005 Van Huystee ..... 5/93.1

* cited by examiner

CHILD CONTAINMENT STRUCTURE WITH VENTILATION PANEL

This application is a continuation-in-part of design application Ser. No. 29/185,439, now U.S. Design Pat. No. 500,213, filed Jun. 30, 2003, which is incorporated by reference herein in its entirety.

FIELD OF THE INVENTION

This invention relates to a child containment structure. More specifically, this invention relates to a child containment structure with a ventilation panel to allow passage of air between an interior of the containment structure and an exterior of the containment structure along the child sleeping surface.

BACKGROUND OF THE INVENTION

Child containment structures, such as cribs, bassinets, and playards, provide a safe environment in which a child can rest and/or play. Adequate air circulation along the child sleeping surface is desirable to promote safe and comfortable sleeping. There is a need in the art for an improved child containment structure to promote the passage of air across the child sleeping surface.

SUMMARY OF THE INVENTION

An aspect of the invention relates to a child containment structure that comprises a floor and a sidewall connected to the floor and defining a unitary structure with the floor. The sidewall includes at least one side panel formed at least partially of an air-restricting material and at least one ventilation panel positioned between the floor and the side panel. The ventilation panel has a maximum height smaller than that of the side panel, and the ventilation panel permits air flow between an interior of the containment structure and an exterior of the containment structure along a sleeping surface of the child containment structure.

According to another aspect of the invention, a child containment structure comprises a floor, a sidewall including at least one padded side panel, and at least one ventilation panel positioned between the floor and the side panel to define a unitary structure. The ventilation panel permits air flow between an interior of the containment structure and an exterior of the containment structure along a sleeping surface of the child containment structure.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Child containment structures, such as cribs, bassinets, and playards, provide a safe environment in which a child can rest and/or play. It is important in such child containment structures that adequate air flow be provided across the sleeping surface of the structure. In the past, adequate air flow was achieved by including all-mesh sidewalls in the structure. The child containment structure of the present invention includes a floor, a sidewall, and a ventilation panel as part of the sidewall, strategically located between the side panel of the sidewall and the floor so that adequate air flow occurs between an interior of the containment structure and an exterior of the containment structure along a surface of the floor. The ventilation panel can be dimensioned so that it is substantially level with a child's head when the child is lying down in the child containment structure.

Figure 1:
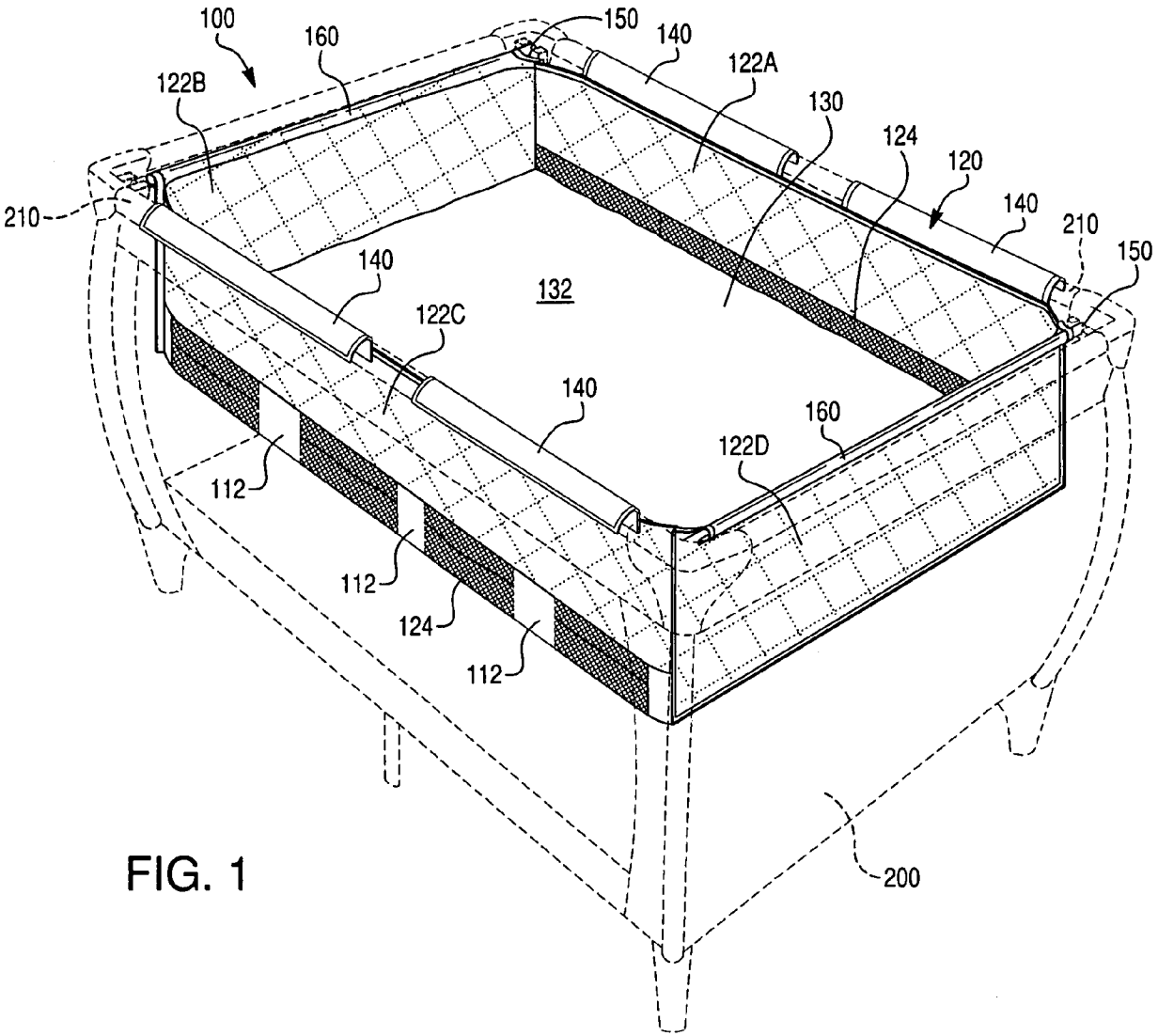
FIG. 1 is a top perspective view of a bassinet that includes a ventilation panel according to an embodiment of the invention mounted to a playard.

Because the child containment structure includes a ventilation panel, the side panel of the sidewall can be made of a more comfortable and more protective fabric material than mesh, even if that material is an air-restricting material. For example, a bassinet designed to be mounted to a playard, as shown in FIG. 1, can include a side panel formed of a quilted material, similar to bumper pad material for a standard crib. As another example, a ventilation panel can be incorporated into the sidewall of a free-standing bassinet, such as that shown in FIGS. 4–5 and that disclosed in co-pending application Ser. No. 10/808,592, field Mar. 25, 2004, which is incorporated by reference herein in its entirety. The free-standing bassinet has soft comfortable side panel material. Further, a playard for outdoor use having a water-protective floor can include a ventilation panel at its lower corners, both for ensuring adequate air flow where the side panels meet and for water drainage in the event of inclement weather.

Figure 2:
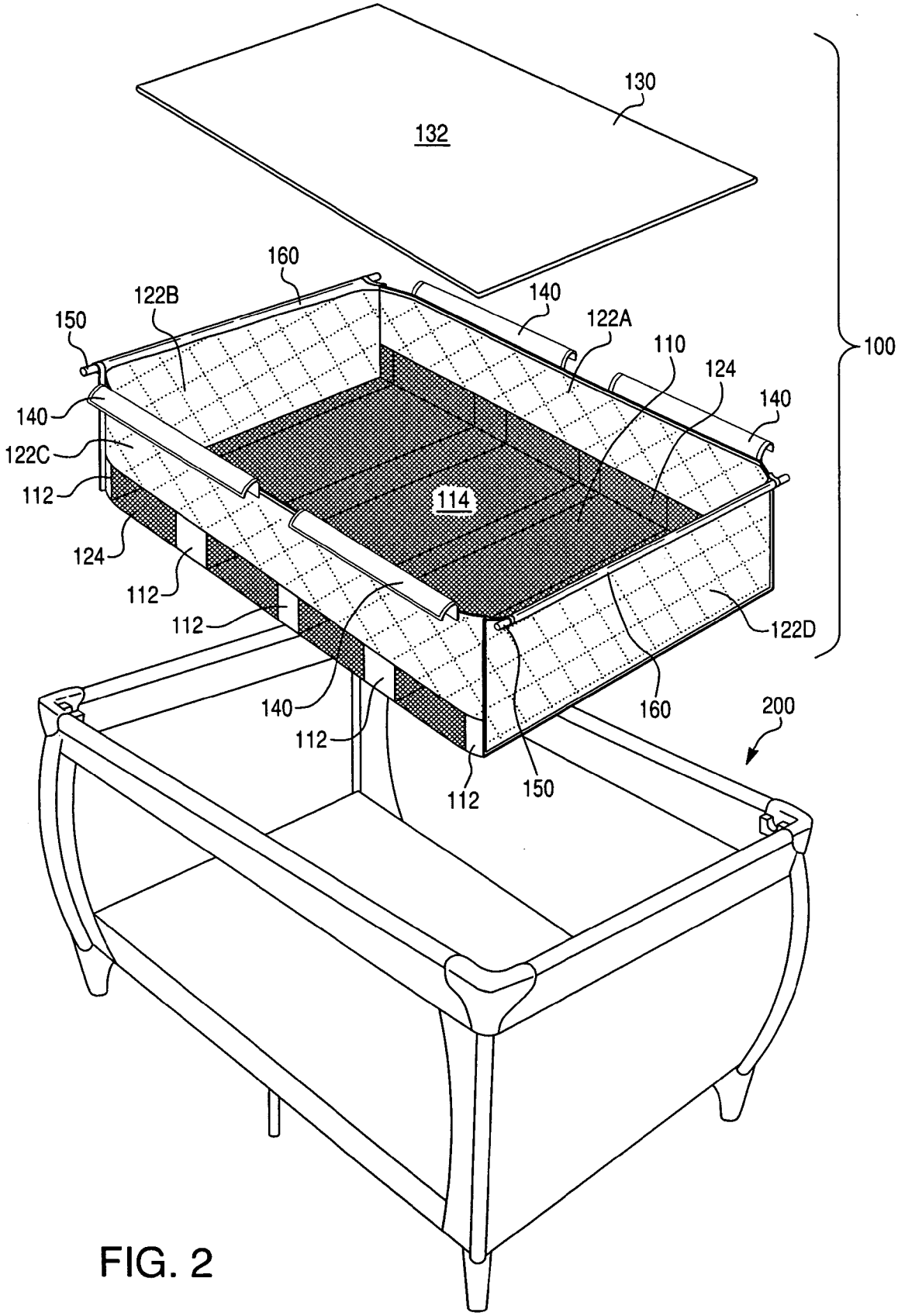
FIG. 2 is an exploded view of the bassinet and playard of FIG. 1.
Figure 3:
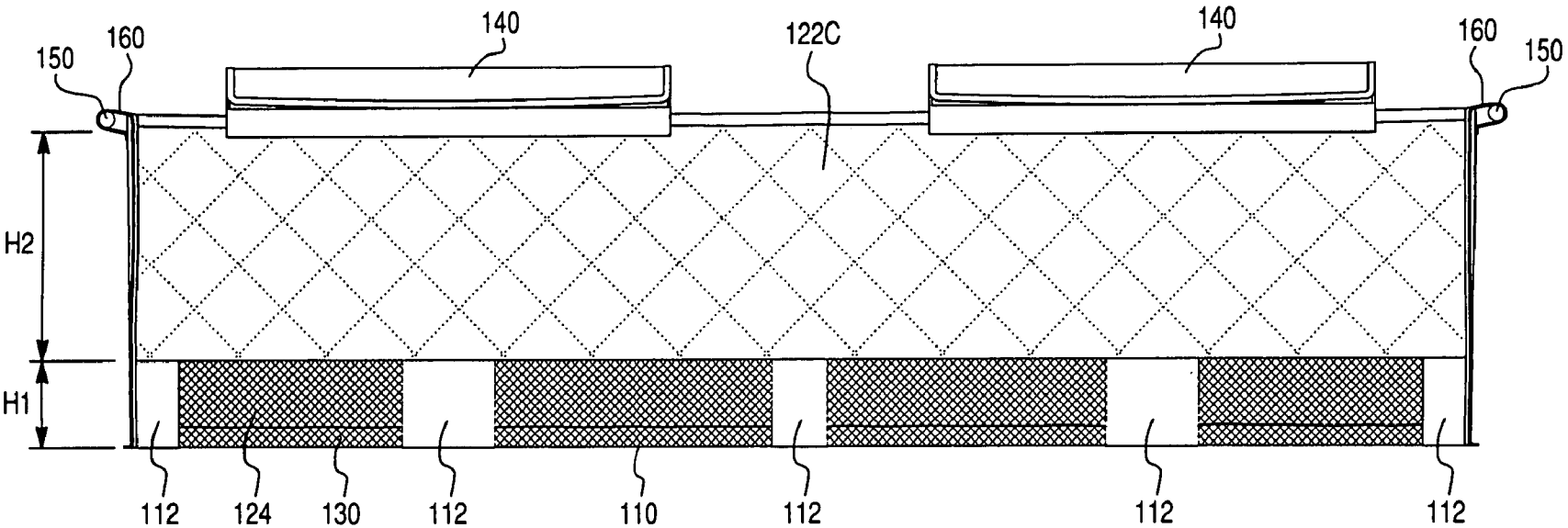
FIG. 3 is a side elevation view of the bassinet of FIG. 1.

FIGS. 1–3 show an embodiment of a child containment structure in accordance with the invention. The child containment structure of this embodiment is a bassinet 100 that is mounted to a playard 200. The playard 200 is shown in dashed line in FIG. 1 for ease of understanding of the bassinet structure. The bassinet 100 includes a floor 110, shown best in FIG. 2, and a sidewall 120 connected to the floor 110 to define a unitary structure with the floor 110. The floor 110 can be planar, or it can curve upward at its edges to join sidewall 120. The floor 110 can be formed of a mesh material, as shown in FIGS. 1–3, or it can be formed of any other suitable material, such as nylon, polyester, a poly nylon blend, and cotton. A mattress pad 130 can be positioned above the floor 110 of the bassinet 100 to provide a comfortable sleeping/playing surface for the child. A fitted sheet can be placed over the mattress pad 130 for additional comfort. Alternatively, the floor 110 itself can include padding to provide a cushioned sleeping/playing surface.

The sidewall 120 of this embodiment includes four side panels 122A, 122B, 122C, 122D arranged in a rectangular shape. The side panels 122A, 122B, 122C, 122D of this embodiment are formed of quilted padding. In other embodiments, the side panels 122A, 122B, 122C, 122D can be formed of nylon, polyester, a poly nylon blend, cotton, Lycra®, or other materials that provide a comfortable, protective environment for the child. Side panels 122A, 122C additionally include a ventilation panel 124 positioned between the floor 110 and the respective side panels 122A, 122C. The ventilation panels 124 each have a maximum height H1 smaller than the maximum height H2 of their respective side panel 122A, 122C, as seen in FIG. 3. In addition, the side panels 122A, 122B, 122C, 122D are formed at least partially of an air-restricting material by comparison to the material of the ventilation panels 124. In this regard, the ventilation panels 124 permit air flow between an interior of the bassinet 100 and an exterior of the bassinet 110 along an upper surface 114 of the floor 110.

The ventilation panels 124 can be made of a mesh material, a breathable fabric with a high air flow rate, a perforated rigid material, or any other material that enables sufficient air flow between the interior and the exterior of the bassinet 100. A child lying close to side panels 122A, 122C of the bassinet 100 will have fresh air circulation through the ventilation panels 124 and, thus, will not re-breathe its own expelled air. The ventilation panels 124 provide a comfortable and safe sleeping environment, while enabling use of more versatile side panel material than mesh, such as warmer, softer, and/or darker, light-blocking materials.

As can be seen in FIG. 3, the ventilation panel 124 extends above the upper surface 132 of the mattress pad 130. The ventilation panel 124 can extend, for example, about 1 inch above the pad's upper surface 132.

Various alternatives to the bassinet embodiment illustrated in FIGS. 1–3 are contemplated. It will be understood that in other embodiments of bassinet 100, the sidewall 120 may have more than four, or fewer than four, side panels. For example, the sidewall 120 may be oval in shape and, hence, have only a single side panel, unbroken by a corner joint. It will also be understood that fewer or more side panels than shown in FIGS. 1–3 can include ventilation panels 124. For example, only one or all of the side panels can include respective ventilation panels 124. Further, although the ventilation panels 124 are shown as single continuous strips extending along the entire length of respective side panels 122A, 122C in the embodiment of FIGS. 1–3, other shapes and configurations of segments 124 are envisioned. For example, the single continuous strip may be divided into adjacent segments of ventilation material by nylon or some other air-restricting material, effectively resulting in more than one ventilation panel positioned between the floor and the respective side panel. In addition, the ventilation panels 124 may have a shape that varies along the length of the side panel; for example, the upper edge of the segment may curve or undulate. In the latter example, the height of the ventilation panel 124 would vary along its length, but the maximum height of the ventilation panel still would be smaller than a minimum height of the side panel.

In addition to the above features, the bassinet 100 can include mounting fixture to mount the bassinet 100 to the playard 200. These mounting fixtures can include curved, plastic brackets 140 that suspend the bassinet 100 from the top rails 210 of the playard. The mounting fixtures also can include rods 150 that extend through sleeves 160 at opposite ends of the bassinet 100. The rods 150 can fit into pockets molded into the playard frame. These mounting fixtures are exemplary only; other suitable mounting fixture may be integrated into the bassinet and/or playard to facilitate mounting the bassinet to the playard.

Further, the bassinet 100 also can include straps 112 of webbing extending across the width of the ventilation panel 124 and the floor 100, on an exterior of the bassinet 100, to lend additional structural stability to the floor 110.

Although the bassinet 100 shown in FIGS. 1–3 extends the entire length of the playard 200, it will be understood that, in other embodiments, the bassinet may be dimensioned to extend less than the entire length of the playard, for example, three quarters the length of the playard.

Figure 4:
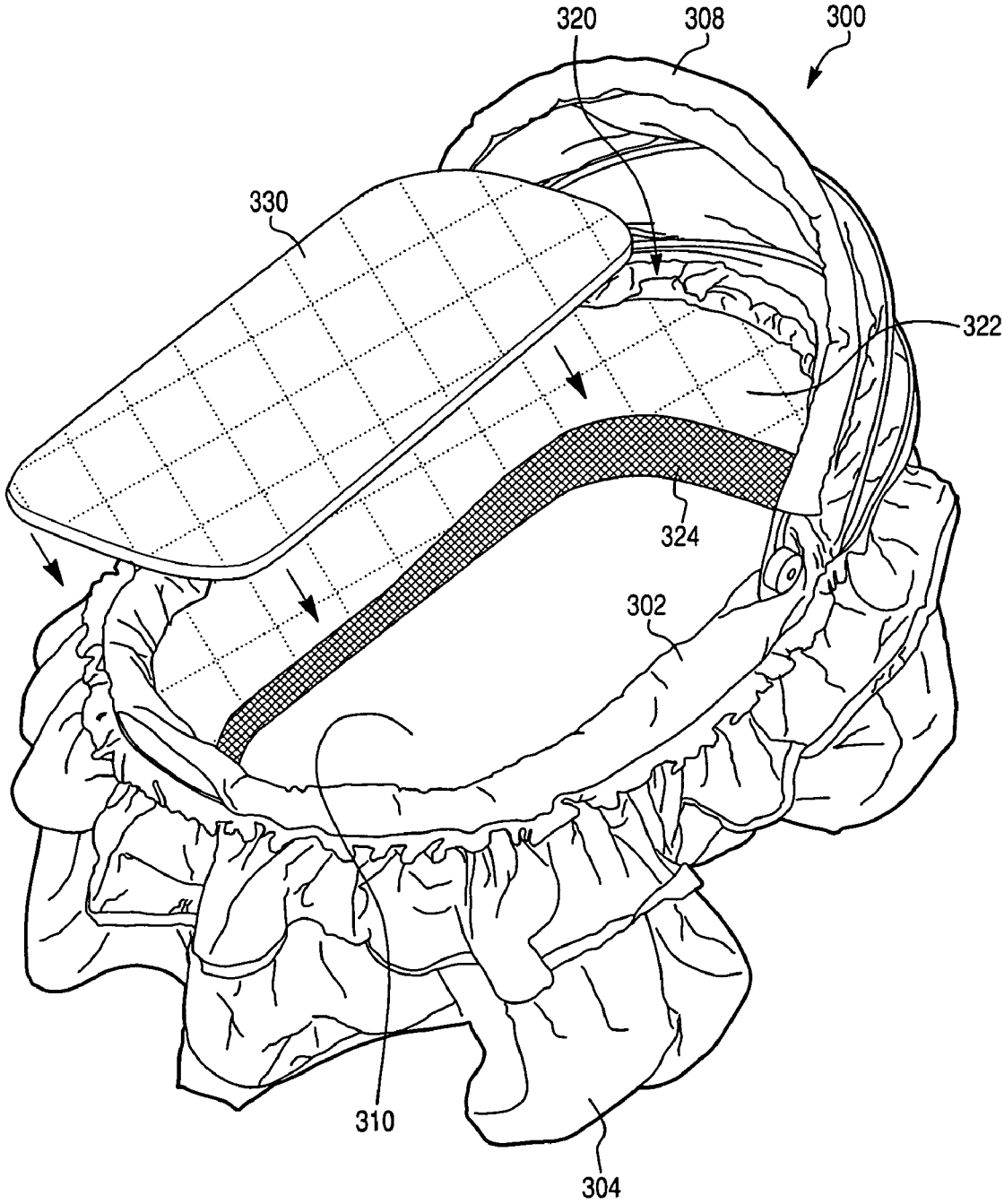
FIG. 4 is a partially exploded, top perspective view of an alternative bassinet that includes a ventilation panel according to an embodiment of the invention.
Figure 5:
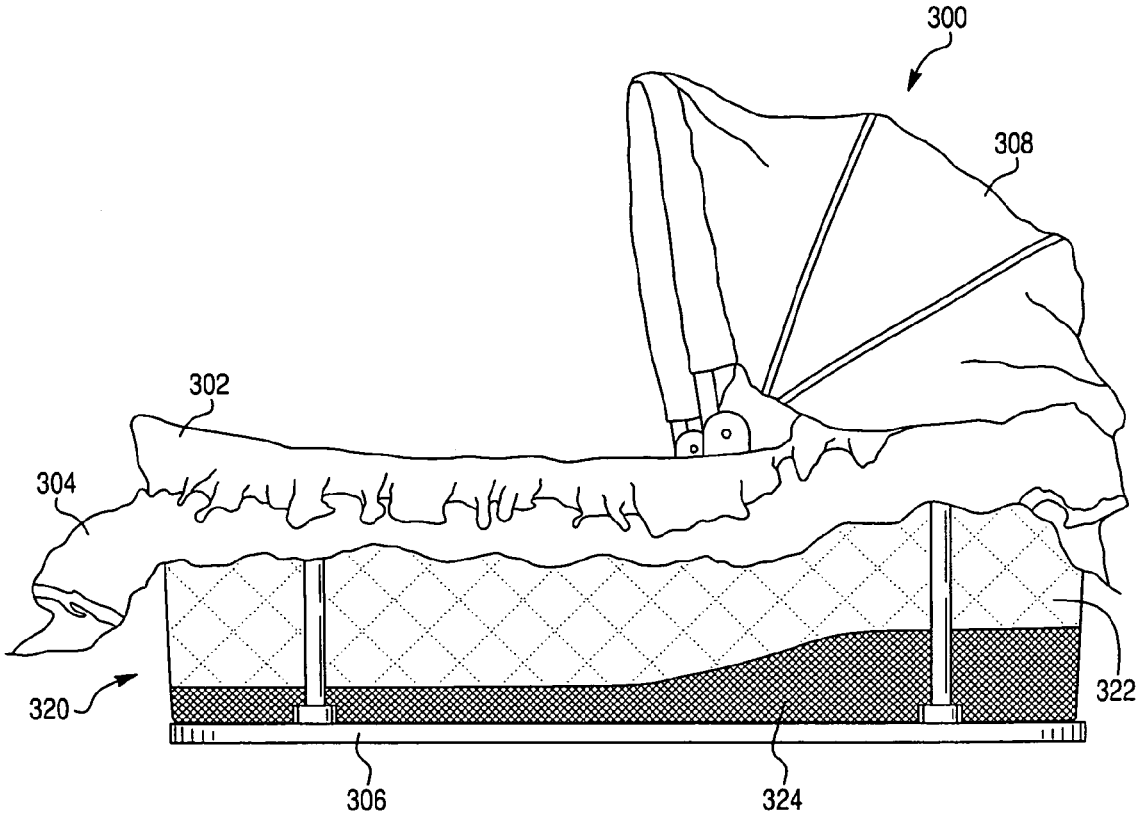
FIG. 5 is a side elevation view of the bassinet of FIG. 4, with a portion of the outer skirt of the bassinet cover cut away to make the ventilation panel visible.

Ventilation panels can be employed in child containment structures other than bassinets for use with playards. FIGS. 4–5 show a free-standing bassinet 300 that includes a fabric bassinet cover 302 and a bassinet frame 304 (obscured in FIG. 4 by the bassinet cover). An example of such a bassinet is disclosed in co-pending application Ser. No. 10/808,593, filed Mar. 25, 2004, which is incorporated by reference herein in its entirety; as described, the bassinet frame includes a base 306 with an inclinable panel (not shown) to allow an end of the bassinet sleeping surface to be elevated. The bassinet cover 302, which is configured to provide a child containment structure when mounted to the frame, has a floor 310 and a sidewall 320 connected to the floor 312 to define a unitary structure with the floor 310. The sidewall 320 includes a single, oval-shaped side panel 322 formed of an air-restricting material. The sidewall 320 also includes a ventilation panel 324 positioned between the floor 310 and the side panel 322. The ventilation panel 324 of this bassinet embodiment is continuous, extending around the entire sidewall 320 of the bassinet 300. The height of the ventilation panel 324 varies along its length. That is, the ventilation panel 324 gradually increases in height as the segment 324 approaches one end of the bassinet 300, shown as the right end in FIG. 5.

The increase in height of the ventilation panel 324 can be advantageous. If a child caregiver wants to raise the bassinet mattress pad 330 to help a child breathe easier, the child caregiver can adjust the pad at the end of the bassinet where the ventilation panel 324 increases in height and still preserve the air flow across the upper surface of the mattress pad 330. In the raised condition, the upper surface of the mattress pad 330 can remain below the upper edge of the ventilation panel 324 so that air can pass freely between the interior and the exterior of the bassinet along the upper surface of the mattress pad 330.

The alternatives discussed above in connection with the structure of the bassinet of FIGS. 1–3, such as the number of side panels and the segmenting of the ventilation panel, apply to the bassinet of FIGS. 4–5 as well.

In addition to the above-described structural features of the bassinet 300, the bassinet cover 302 can include an outer skirt 304 (partially cut-away in FIG. 5). The outer skirt 302 can extend down from an upper edge of the bassinet 300 to the ventilation panel 324, and even beyond the ventilation panel 324; however, the outer skirt 304 is designed to remain spaced from the ventilation panel 324 so that air flow between the interior and the exterior of the bassinet 300 through the ventilation panel 324 is not restricted. The bassinet 300 also can include a collapsible canopy 308.

Figure 6:
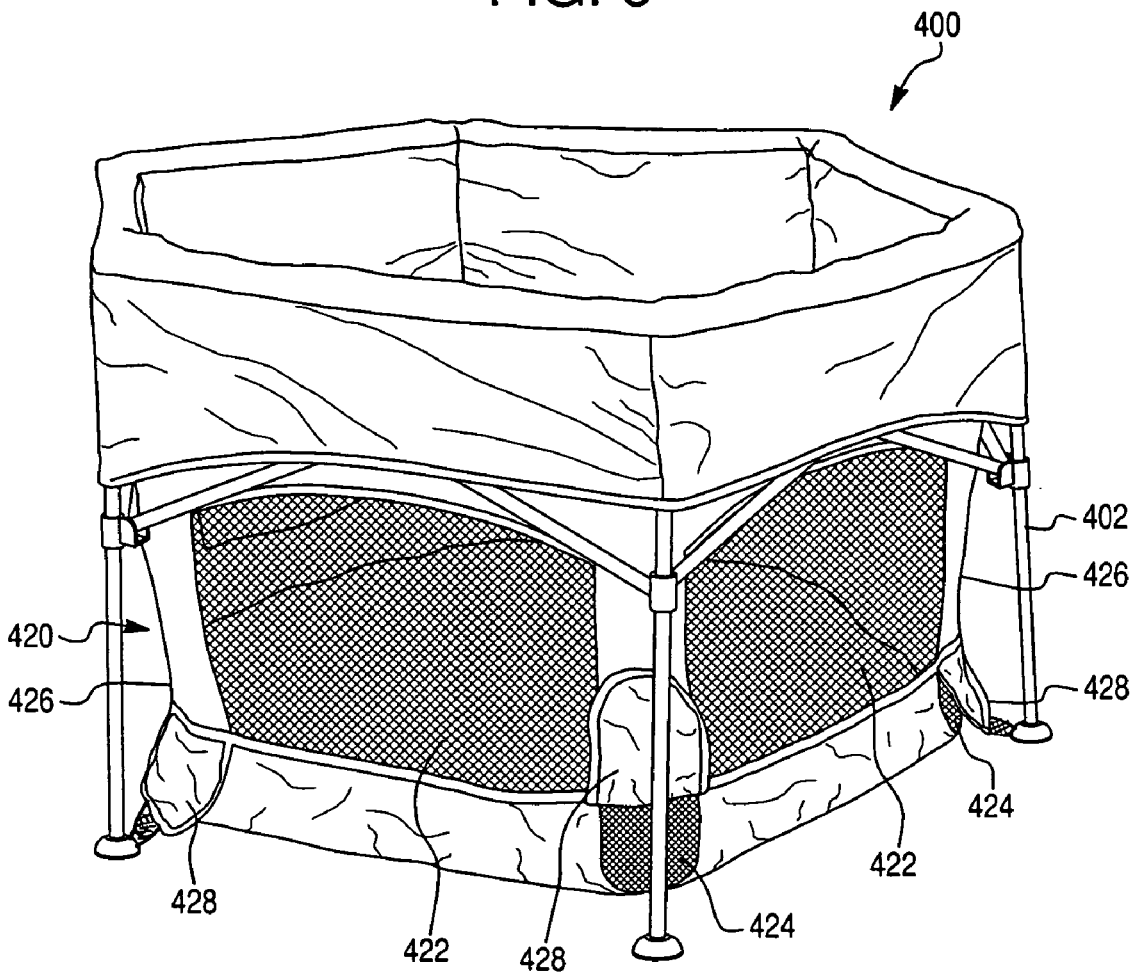
FIG. 6 is a side perspective view of an alternative playard that includes a ventilation panel according to an embodiment of the invention.
Figure 7:
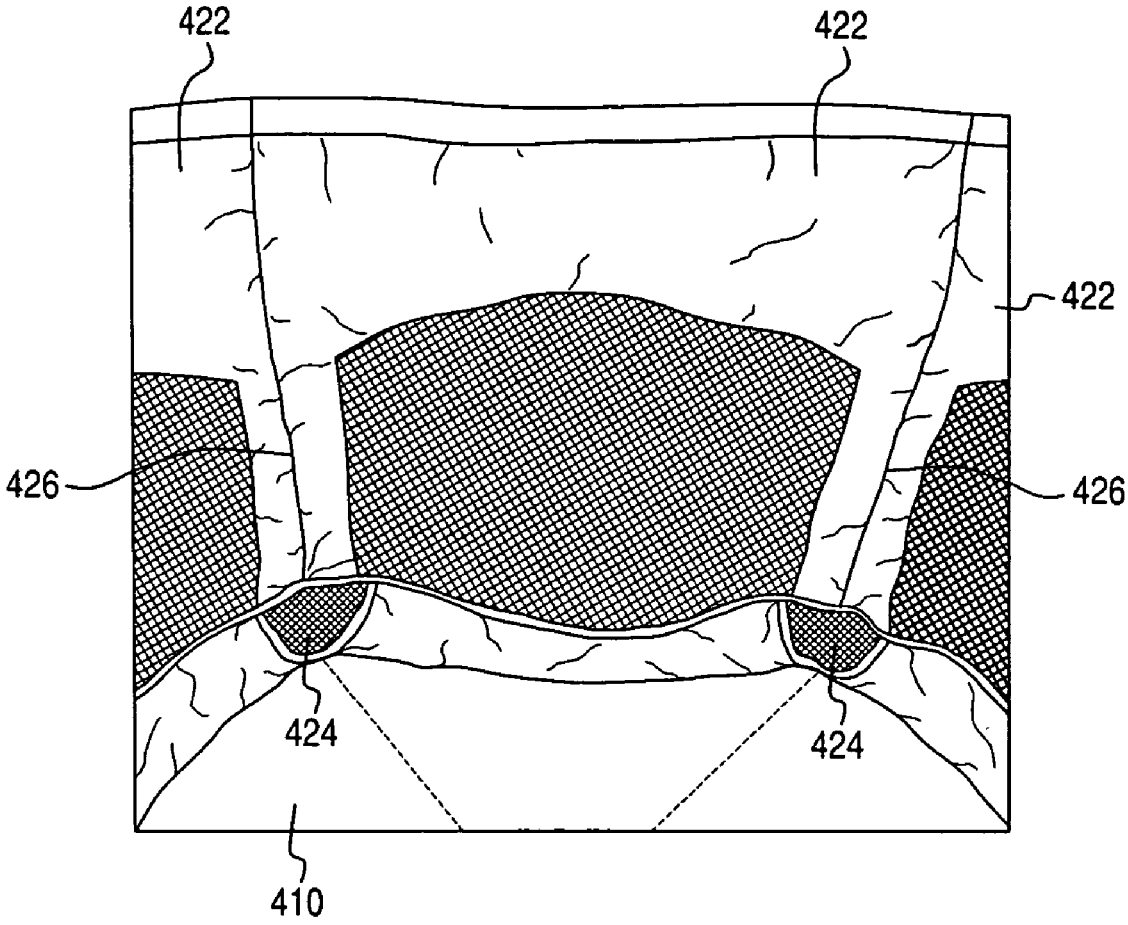
FIG. 7 is an enlarged view of a portion of the playard of FIG. 6, taken from inside of the playard.

FIGS. 6–7 show a playard 400 that includes a frame 402 (a representative frame leg is labeled in FIG. 6), a floor 410, and a sidewall 420 having side panels 422 and ventilation panels 424. An exemplary frame 402 for playard 400 is described in co-pending application Ser. No. 10/446,132, filed May 28, 2003, which is incorporated by reference herein in its entirety. The sidewall 420 is connected to the floor 410 and defines a unitary structure with the floor 410. Adjacent side panels 422 form corners 426, and ventilation panels 424 are located at each corner 426 between the adjacent side panels 422 and the floor 410. The ventilation panels 424 permit air flow between an interior of the playard 400 and an exterior of the playard along the sleeping (or playing) surface of the playard 400. The sleeping surface can be provided by an upper surface of a mattress pad (not shown) placed on the floor 410 or by the floor 410 itself. If the playard 400 is used outdoors, the ventilation panels 424 also serve as a drainage site for any water that enters an interior of the playard 400. In this regard, the floor 410 can be formed of a water-resistant material, and it can be slightly raised at its center so that any water captured in the interior of the playard 400 flows toward the corner ventilation panels 424.

The side panels 422 themselves can be formed of mesh, nylon, a combination of mesh and nylon, as seen in FIGS. 5–6, or any other suitable material. The presence of the ventilation panels 424 enables use of more versatile materials for the side panels 422. For example, the side panels 422 can be formed of a heavier, sturdier, and/or air-restricting material to guard against rough surfaces, wind, water, and sun.

The playard 400 also can include flaps 428 positioned on the exterior of the sidewall 420 to cover each corner ventilation panel 424. These flaps 428 can serve to keep sand or small debris from blowing into the interior of the playard 400 through the corner ventilation panels 424. Although FIG. 6 illustrates one flap 428 rotated up relative to the floor of the playard 400, the flaps 428 extend downward from their connection points to the sidewall 420. In addition, the flaps 428 can be secured to the feet of the respective frame legs by straps, for example, straps of webbing as shown in FIG. 6 (see rightmost and leftmost flaps), to maintain the flaps 428 slightly spaced from the corner ventilation panels 424, thereby promoting air flow through the panels 424.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A child containment structure comprising:

a floor; and a continuous, fabric sidewall having a lower edge connected to a perimeter of the floor and defining a unitary structure with the floor, the sidewall including at least one side panel formed at least partially of an air-restricting material and at least one ventilation panel positioned between the floor and the at least one side panel, the at least one ventilation panel permitting air flow between an interior of the child containment structure and an exterior of the child containment structure along a sleeping surface of the child containment structure, wherein a height of the at least one ventilation panel varies along its length, and the maximum height of the at least one ventilation panel is smaller than a minimum height of the at least one side panel.

2. A child containment structure according to claim 1, further comprising a mattress pad positioned above the floor.

3. A child containment structure according to claim 1, wherein the floor includes padding.

4. A child containment structure according to claim 1, wherein the air-restricting material comprises at least one of padding and nylon.

5. A child containment structure according to claim 1, wherein the at least one ventilation panel comprises at least one of mesh and another perforated material.

6. A child containment structure according to claim 1, wherein the sidewall includes at least four side panels, and wherein the at least one ventilation panel includes at least four ventilation panels, each of the ventilation panels positioned between the floor and a respective one of the side panels.

7. A child containment structure according to claim 1, wherein the at least one ventilation panel comprises more than one ventilation panel positioned between the floor and the side panel.

8. A child containment structure according to claim 1, wherein the at least one side panel comprises at least four side panels, adjacent ones of the side panels forming corners therebetween, and wherein the at least one ventilation panel includes ventilation material located at each of the corners.

9. A child containment structure comprising:

a floor a continuous sidewall including at least one padded side panel and at least one ventilation panel positioned between the floor and the at least one side panel, the sidewall having a lower edge connected to a perimeter of the floor to define a unitary structure with the floor, the at least one ventilation panel permitting air flow between an interior of the child containment structure and an exterior of the child containment structure along a sleeping surface of the child containment structure, wherein a height of the at least one ventilation panel varies along its length, and the maximum height of the at least one ventilation panel is smaller than a minimum height of the at least one side panel.

10. A child containment structure according to claim 9, further comprising a mattress pad positioned above the floor.

11. A child containment structure according to claim 9, wherein the at least one ventilation panel comprises at least one of mesh and another perforated material.

12. A child containment structure according to claim 9, wherein the sidewall includes at least four side panels, and wherein the at least one ventilation panel includes at least four ventilation panels, each of the ventilation panels positioned between the floor and a respective one of the side panels.

13. A child containment structure according to claim 9, wherein the at least one ventilation panel comprises more than one ventilation panel positioned between the floor and the side panel.

14. A child containment structure according to claim 9, wherein the at least one side panel comprises at least four side panels, adjacent ones of the side panels forming corners therebetween, and wherein the at least one ventilation panel includes ventilation material located at each of the corners.

15. A child containment structure comprising:

a floor; and a sidewall having a lower edge connected to a perimeter of the floor and defining a unitary structure with the floor, the sidewall including at least one side panel formed at least partially of an air-restricting material and at least one ventilation panel positioned between the floor and the at least one side panel, the at least one ventilation panel permitting air flow between an interior of the child containment structure and an exterior of the child containment structure along a sleeping surface of the child containment structure, wherein the at least one ventilation panel extends from a first end of the child containment structure to a second end of the child containment structure, and the at least one ventilation panel has a height that varies along its length and that is greater at the first end than at the second end.

16. A child containment structure comprising:

a floor; and a sidewall having a lower edge connected to a perimeter of the floor and defining a unitary structure with the floor, the sidewall including at least one side panel formed at least partially of an air-restricting material and at least one ventilation panel positioned between the floor and the at least one side panel, the at least one ventilation panel permitting air flow between an interior of the child containment structure and an exterior of the child containment structure along a sleeping surface of the child containment structure, wherein the at least one ventilation panel has a height that varies along its length and that has a maximum height at one end of the child containment structure.

* * * * *